US007369024B2

(12) United States Patent
Yargole et al.

(10) Patent No.: US 7,369,024 B2
(45) Date of Patent: May 6, 2008

(54) COMPACT DRY TRANSFORMER

(75) Inventors: Arun Dattatraya Yargole, Maharashtra (IN); Kishor Uddhav Joshi, Maharashtra (IN)

(73) Assignee: Crompton Greaves Limited, Mumbai (IN)

( * ) Notice: Subject to any disclaimer, the term of this patent is extended or adjusted under 35 U.S.C. 154(b) by 0 days.

(21) Appl. No.: 11/573,545

(22) PCT Filed: Aug. 10, 2004

(86) PCT No.: PCT/IN2004/000261

§ 371 (c)(1),
(2), (4) Date: Feb. 9, 2007

(87) PCT Pub. No.: WO2006/016377

PCT Pub. Date: Feb. 16, 2006

(65) Prior Publication Data

US 2007/0247266 A1 Oct. 25, 2007

(51) Int. Cl.
*H01F 27/08* (2006.01)

(52) U.S. Cl. ..... 336/61; 336/5; 336/55; 336/59

(58) Field of Classification Search ..... 336/55, 336/57–61
See application file for complete search history.

(56) References Cited

U.S. PATENT DOCUMENTS

| | | | | |
|---|---|---|---|---|
| 2,770,785 A | | 11/1956 | Haagens et al. | |
| 3,551,863 A | | 12/1970 | Marton | |
| 3,731,243 A | * | 5/1973 | Davis | 336/61 |
| 5,954,988 A | * | 9/1999 | Lee | 219/757 |
| 6,087,916 A | * | 7/2000 | Kutkut et al. | 336/61 |
| 6,518,868 B1 | * | 2/2003 | Miller et al. | 336/55 |
| 6,563,410 B1 | * | 5/2003 | Marton | 336/55 |
| 6,750,749 B2 | * | 6/2004 | Horiuchi et al. | 336/55 |
| 6,885,268 B2 | * | 4/2005 | Choi | 336/57 |

FOREIGN PATENT DOCUMENTS

| | | |
|---|---|---|
| FR | 2784787 | 4/2000 |
| JP | 2002008923 | 1/2002 |

* cited by examiner

*Primary Examiner*—Anh Mai
(74) *Attorney, Agent, or Firm*—Brich, Stewart, Kolasch & Birch, LLP

(57) ABSTRACT

Compact dry transformer (1A) consisting of a magnetic material core (2) provided with a first heat sink consisting of covers (10) having cooling fins (11) on the outer surface thereof. The transformer also consists of a coil assembly (3,4) provided with a second heat sink consisting of enclosures (12) having cooling fins (14) on the outer surface thereof. The second heat sink further consists of jackets (15) with heat pipes (17) containing a thermic fluid having low boiling point at vacuum such as water. The heat pipes consist of evaporator portions and condenser portions having cooling fins (21) on the outer surface thereof. Due to the heat sinks heat dissipation efficiency of the transformer is improved (FIG. 3).

4 Claims, 11 Drawing Sheets

COMPACT DRY TRANSFORMER

FIELD OF INVENTION

This invention relates to a compact dry transformer.

PRIOR ART

Electrical transformers are generally oil filled or dry. In oil filled transformers, transformer oil is the coolant for cooling the core and coil assembly of the transformer. Oil filled transformers are cost effective and operate generally at temperatures of the order of 70 to 90° C. They, however, require periodic maintenance and replacement of the oil and are susceptible to fire hazards. The transformer oil is environmentally polluting and may cause health hazards.

Dry transformers comprise magnetic material core and coil assembly comprising windings with insulation between the turns and layers of the windings. The coil assembly is impregnated and/or encapsulated with a resin for each phase and assembled onto the core and located in a protective metallic tank. Such transformer is generally used for outdoor applications. Alternatively, the core and the impregnated and/or encapsulated coil assembly together is encapsulated further with a resin and used for indoor or outdoor applications without or with the protective metallic tank.

Dry transformers are compact, environmentally compatible and flame proof. They do not require periodic maintenance and are preferred in hazardous areas such as mines, densely populated residential areas or hospitals. Dry transformers generally operate at temperatures of the order of 120 to 180° C. Temperature rise above ambient is the effect of losses in the windings caused by the resistance of the conductors of the windings and the current flowing through the windings and also losses in the magnetic material core. In order to reduce the losses, the windings are normally designed with lower current densities to provide larger crosssectional area of the conductors. This reduces the resistance of the windings and hence the losses. For a given set of design variables a lower current density increases the size and weight of the core. Higher the weight of the core, higher the no load losses. This also increases the cost of the transformer. Therefore, the operating temperatures of a dry transformer cannot be allowed to drop below certain limits if it has to be cost effective. Cooling ducts are known to be provided within or between the windings and core to facilitate passage of coolants such as air for the dissipation of heat and operation of the transformer at lower temperatures. Ducts add to the size and cost of the transformers.

OBJECTS OF THE INVENTION

An object of the invention is to provide a compact dry transformer which has improved heat dissipation efficiency and operates with higher current densities.

Another object of the invention is to provide a compact dry transformer which comprises windings of reduced cross sectional area thereby reducing the size and weight of the transformer.

Another object of the invention is to provide a compact dry transformer having reduced no load losses.

Another object of the invention is to provide a compact dry transformer which eliminates the protective metallic tank but may be used for both indoor and outdoor applications.

DETAILED DESCRIPTION OF THE INVENTION

According to the invention there is provided compact dry transformer consisting of a magnetic material core and a coil assembly consisting of resin impregnated and/or encapsulated windings with insulation between the turns and layers of the windings and assembled onto the core, wherein the core consists of a first heat sink and the coil assembly consists of a second heat sink.

According to an embodiment of the invention, the first heat sink consists of covers snug fitted over the core and provided with cooling fins on the outer surface thereof.

According to an embodiment of the invention, the second heat sink consists of enclosures each provided with a slit along the length thereof and cooling fins on the outer surface thereof.

According to another embodiment of the invention, the second heat sink consists of jackets each provided with a slit along the length thereof and a plurality of the heat pipes each consisting of an evaporator portion and a condenser portion and containing a thermic fluid having low boiling point at vacuum, the evaporator portion being located in pockets or holes provided along the jackets radially spaced and the condenser portion being provided with cooling fins on the outer surface thereof.

According to another embodiment of the invention, the second heat sink consists of sleeves each provided with a slit along the length thereof and cooling fins at one end thereof disposed outside the windings.

According to an embodiment of the invention, the second heat sink consists of enclosures snug fitted over the resin impregnated and/or encapsulated windings on the limbs of the core and provided with slits along the length thereof and cooling fins on the outer surface thereof, the second heat sink further consisting of jackets inserted over the limbs of the core and provided with slits along the length thereof and a plurality of heat pipes each consisting of an evaporator portion and a condenser portion and containing a thermic fluid having low boiling point at vacuum, the evaporator portion being located in pockets or holes provided along the jackets radially spaced and the condenser portion being disposed outside the jackets and provided with cooling fins on the outer surface thereof.

According to another embodiment of the invention, the second heat sink consists of enclosures snug fitted over the resin impregnated and/or encapsulated windings on the limbs of the core and provided with slits along the length thereof and cooling fins on the outer surface thereof, the second heat sink further consisting of sleeves disposed between the windings and provided with slits along the length thereof and cooling fins at one end thereof disposed outside the windings.

According to another embodiment of the invention, the second heat sink consists of enclosures snug fitted over the resin impregnated and/or encapsulated windings on the limbs of the core and provided with slits along the length thereof and cooling fins on the outer surface thereof.

The following is a detailed description of the invention with reference to the accompanying drawings, in which FIG. 1 is elevation of a compact dry transformer according to an embodiment of the invention;

Figure 1:
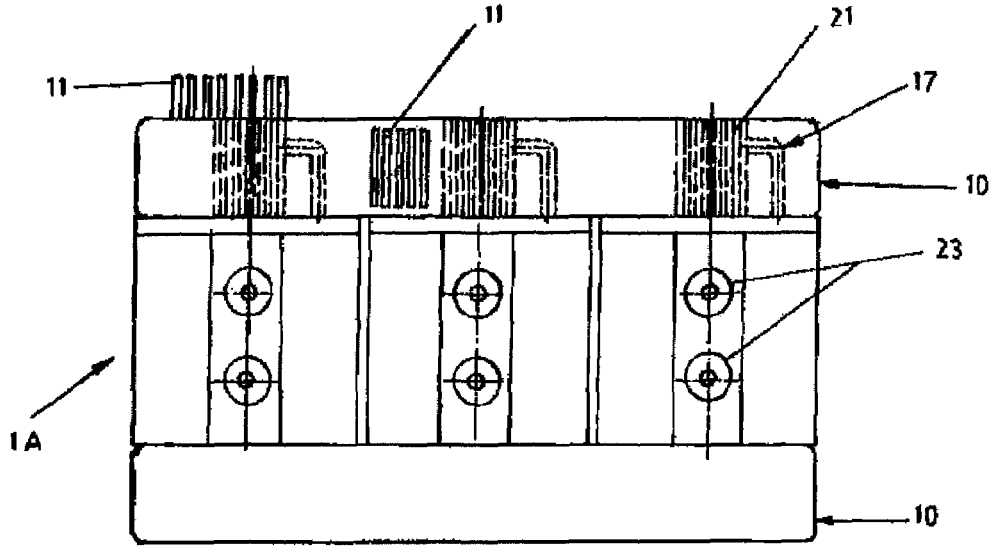
Figure 2:
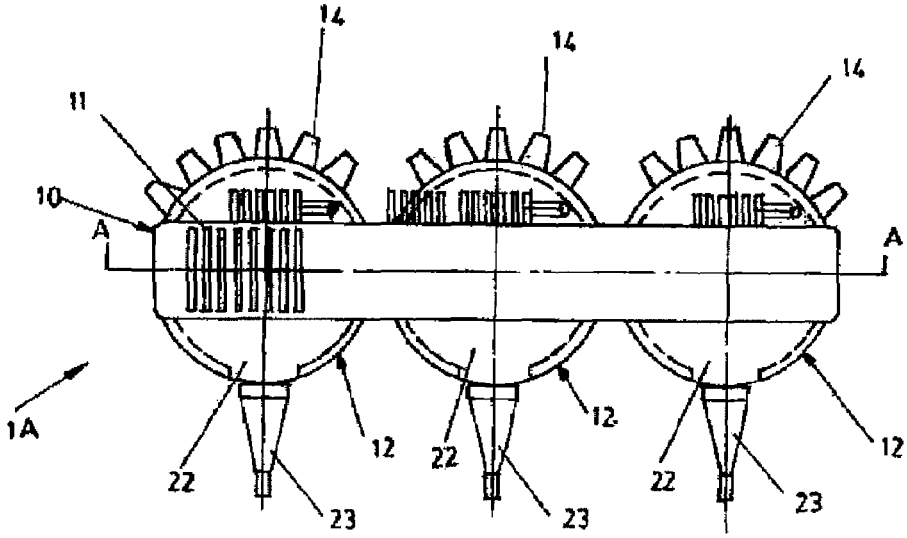
FIG. 2 is top view of the transformer in FIG. 1.
Figure 3:
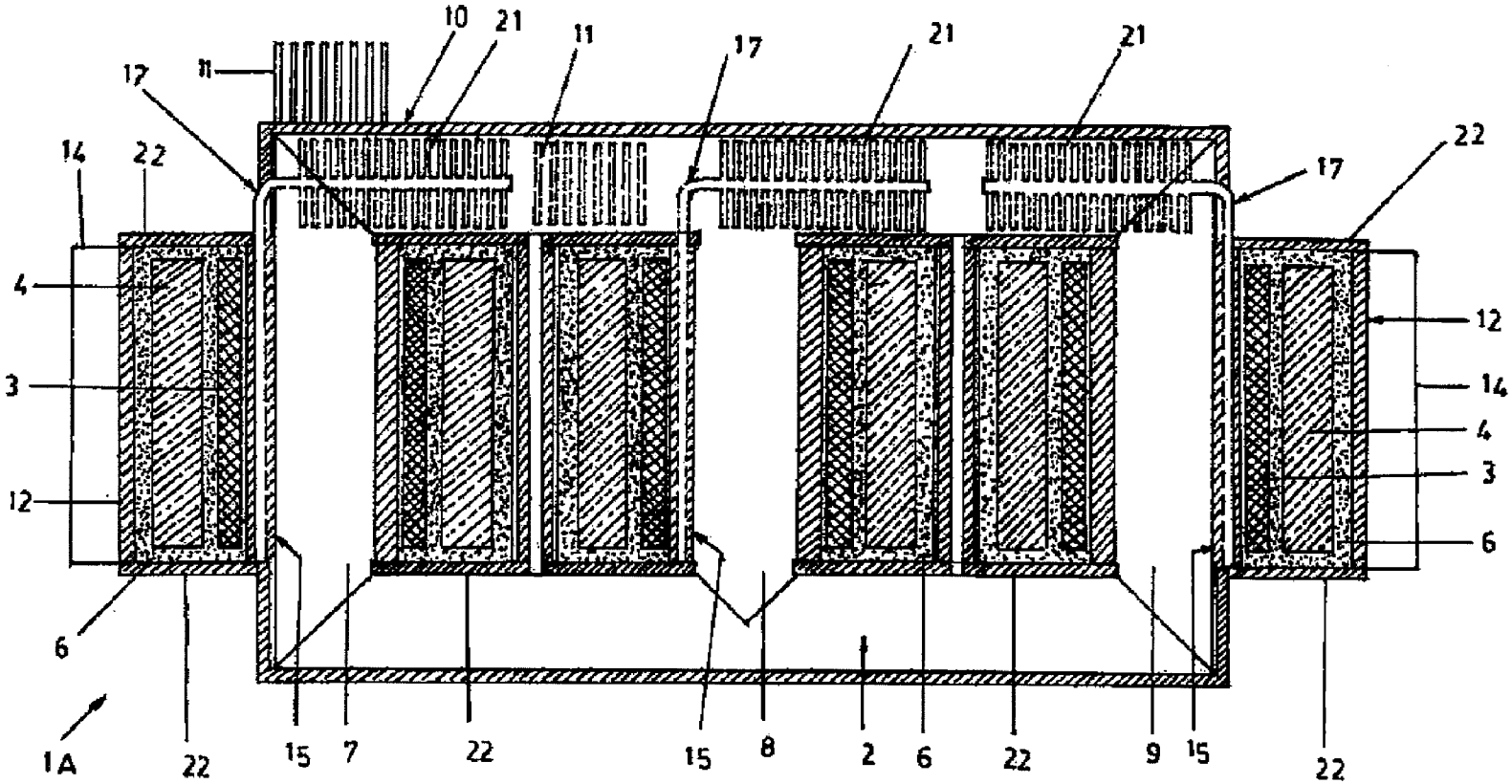
FIG. 3 is crosssection at A-A in FIG. 2.
Figure 4:
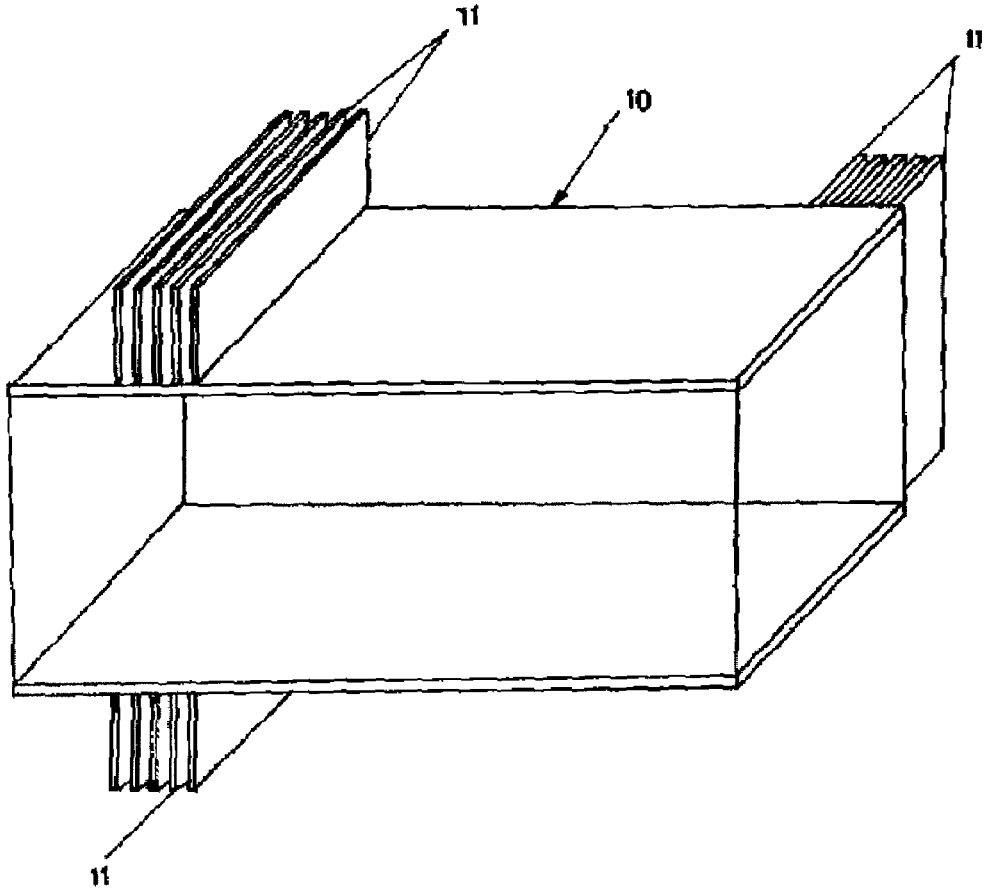
FIG. 4 is isometric view of a cover of a first heat sink of the transformer of FIGS. 1, 2 and 3.
Figure 5:
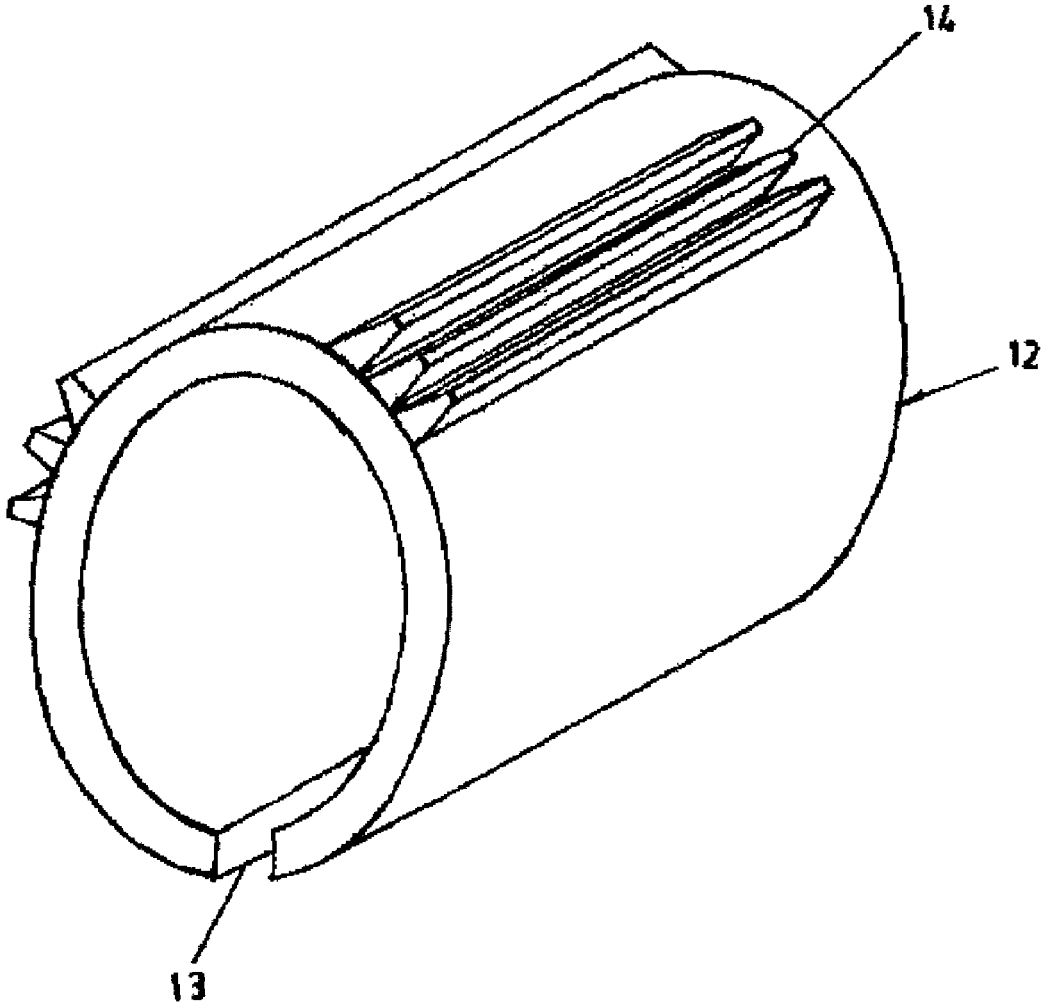
FIG. 5 is isometric view of an enclosure of a second heat sink of the transformer of FIGS. 1, 2 and 3.
Figure 6:
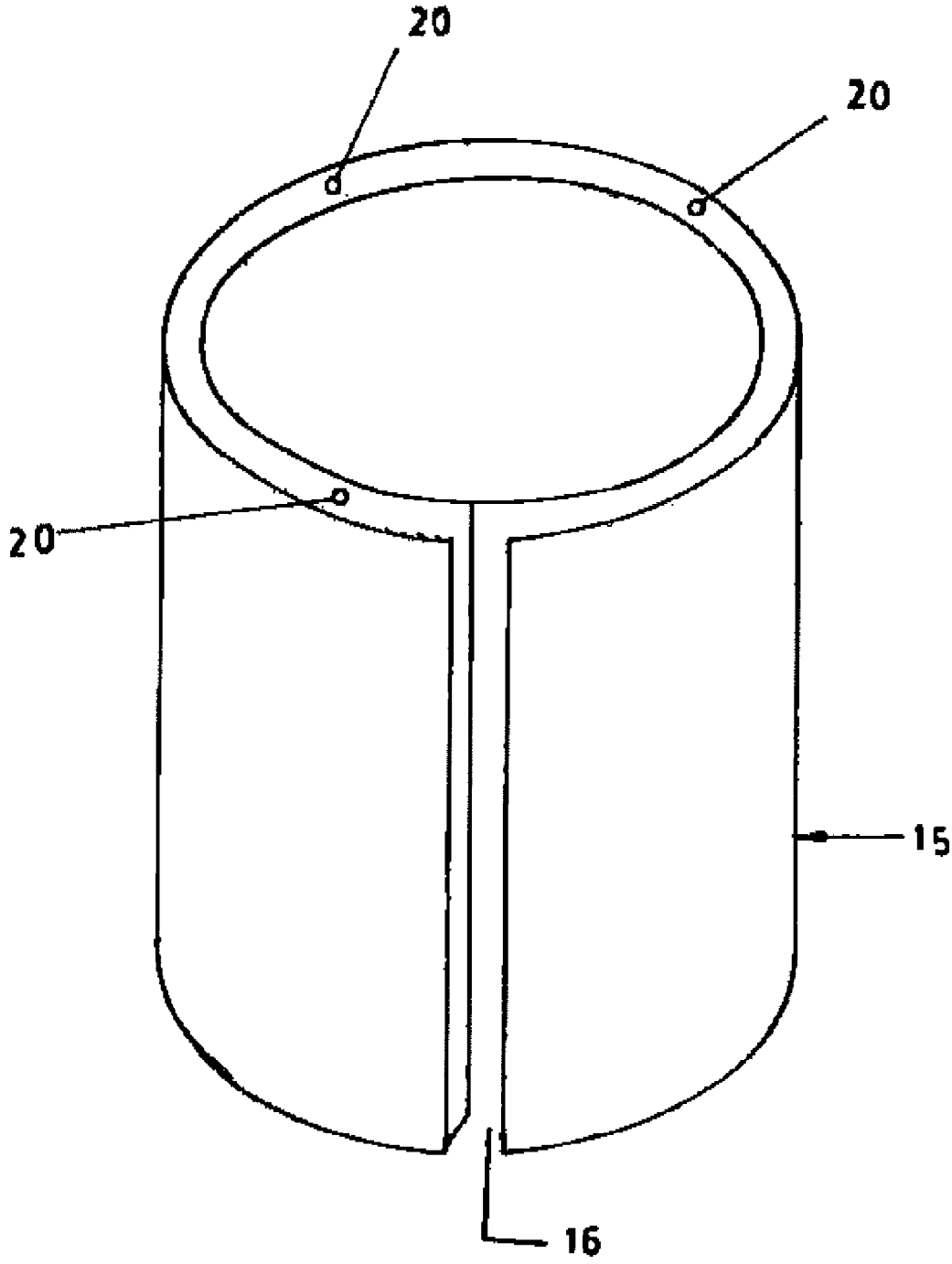
FIG. 6 is isometric view of a jacket of second heat sink of the transformer of FIGS. 1, 2 and 3.
Figure 7:
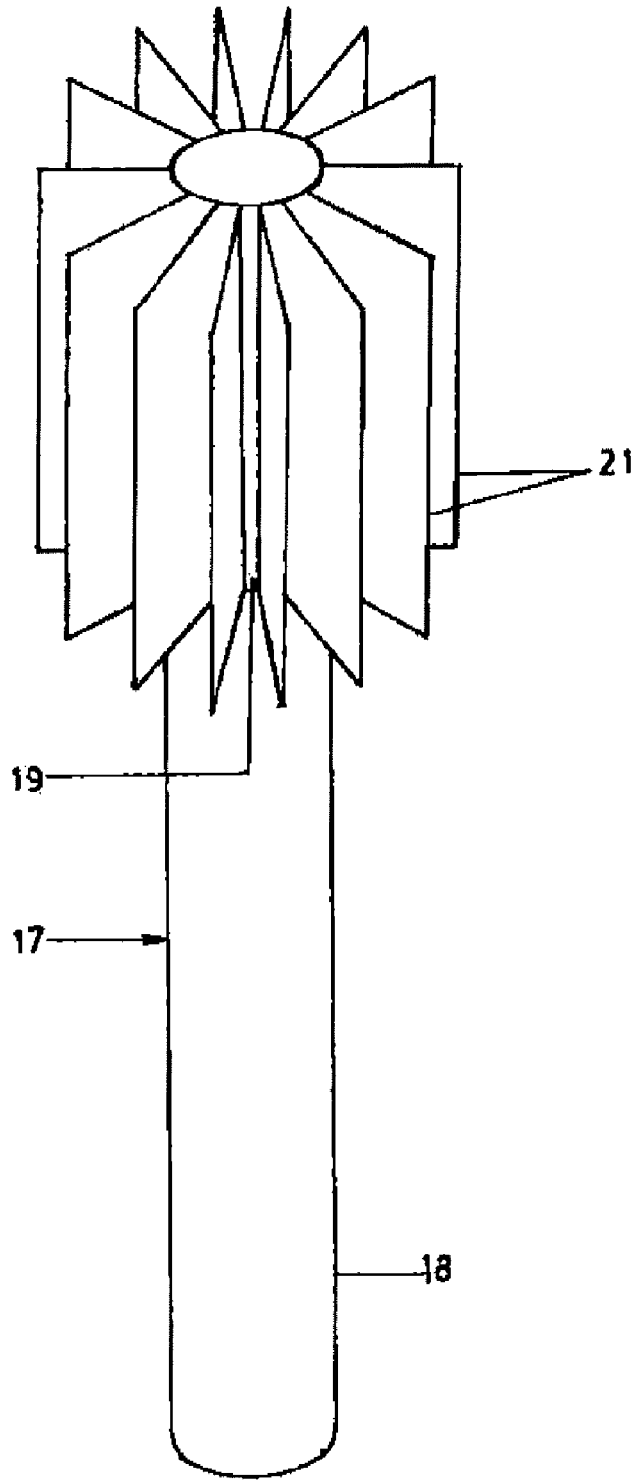
FIG. 7 is isometric view of a heat pipe of the second heat sink of the transformer of FIGS. 1, 2 and 3.
Figure 8:
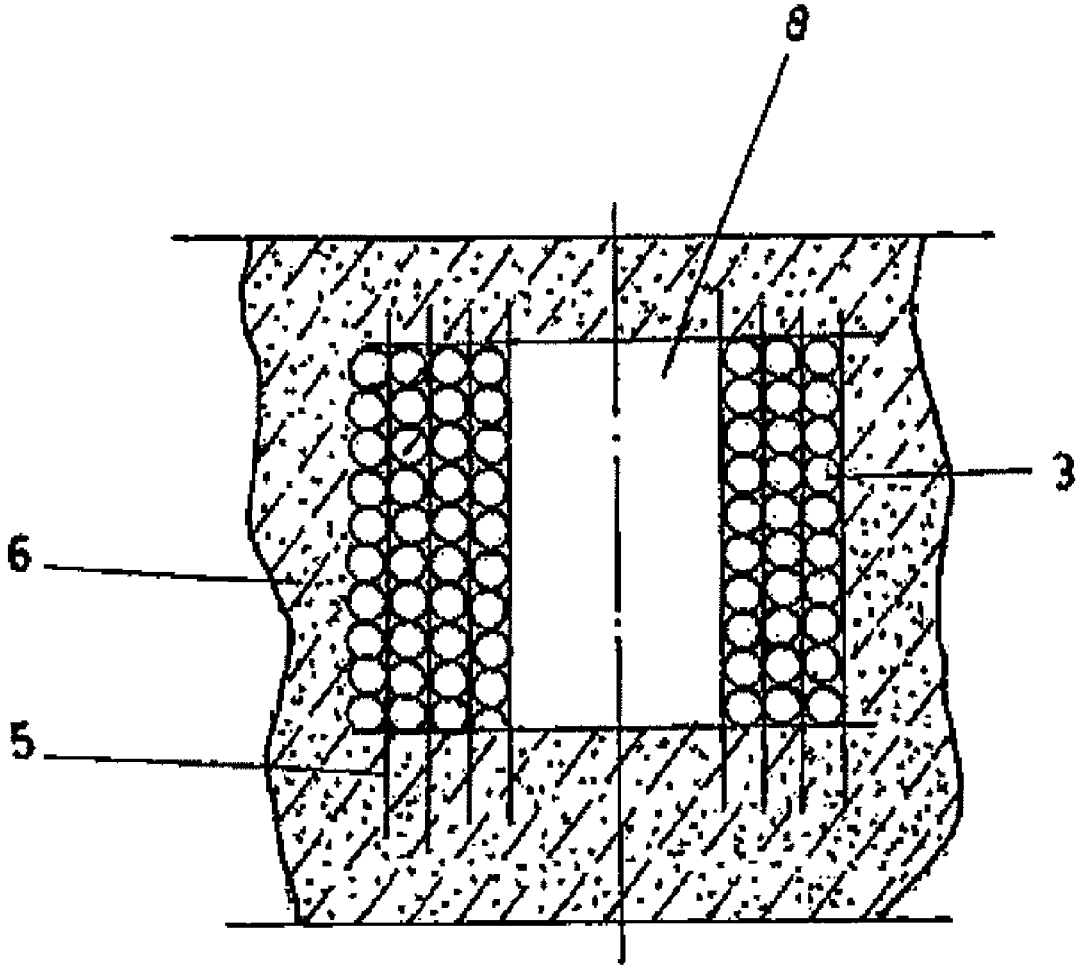
FIG. 8 is scrap crosssectional view of one of the windings mounted on a core limb of the transformer of FIGS. 1, 2 and 3.

The compact dry transformer 1A as illustrated in FIGS. 1 to 8 of the accompanying drawings comprises a magnetic material core 2 and a coil assembly comprising primary windings or low voltage windings 3 and secondary windings or high voltage windings 4 with insulation 5 between the turns and layers of the windings for each phase. The primary and secondary windings are impregnated and/or encapsulated with a resin 6 and assembled onto the three limbs 7, 8 and 9 of the core. The core comprises a first heat sink comprising covers 10 snug fitted over the core and provided with cooling fins 11 over the outer surface thereof. The coil assembly comprises a second heat sink comprising enclosures 12 each provided with a slit 13 along the length thereof and cooling fins 14 on the outer surface thereof. The enclosures are snug fitted over the resin impregnated and/or encapsulated windings on the limbs of the core. The second heat sink further comprises jackets 15 each provided with a slit 16 along the length thereof. A plurality of heat pipes are marked 17, each comprising an evaporator portion 18 and a condenser portion 19. The evaporator portions of the heat pipes are located in pockets or holes 20 provided along the jackets radially spaced. The condenser portions of the heat pipes are disposed outside the jackets and provided with cooling fins 21 on the outer surface thereof. The jackets are inserted over the limbs of the core 2. The heat pipes contain a thermic fluid (not shown) having low boiling point at vacuum such as water. The coil caps are marked 22. The terminals of the transformer are marked 23.

Figure 9:
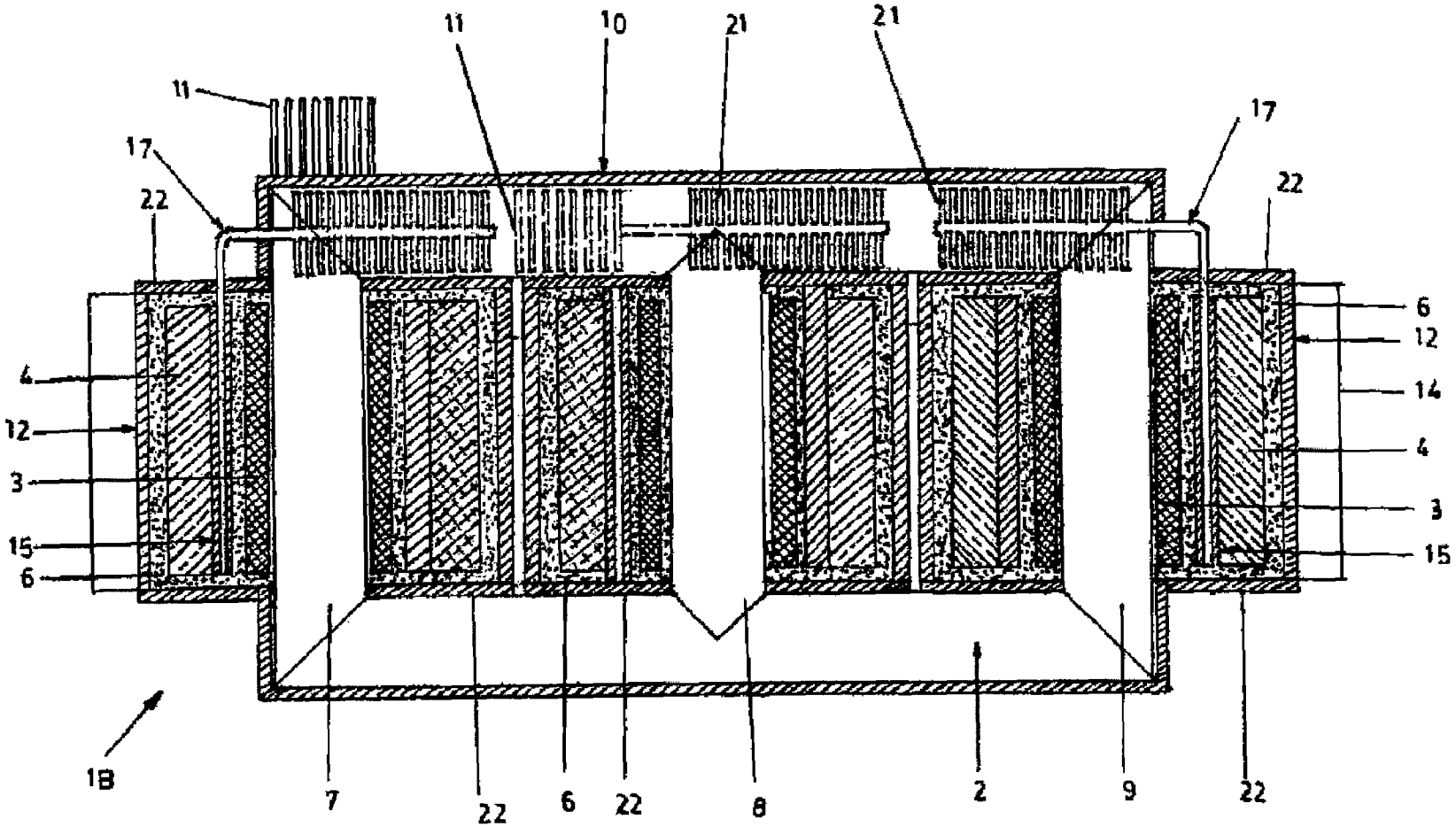
FIG. 9 is crosssection of a compact dry transformer according to another embodiment of the invention.

The transformer 1B of FIG. 9 of the accompanying drawings is the same as the transformer as illustrated in FIGS. 1-8 except that the jackets with heat pipes are inserted between the resin impregnated and/or encapsulated windings on the limbs of the core 2.

Figure 10:
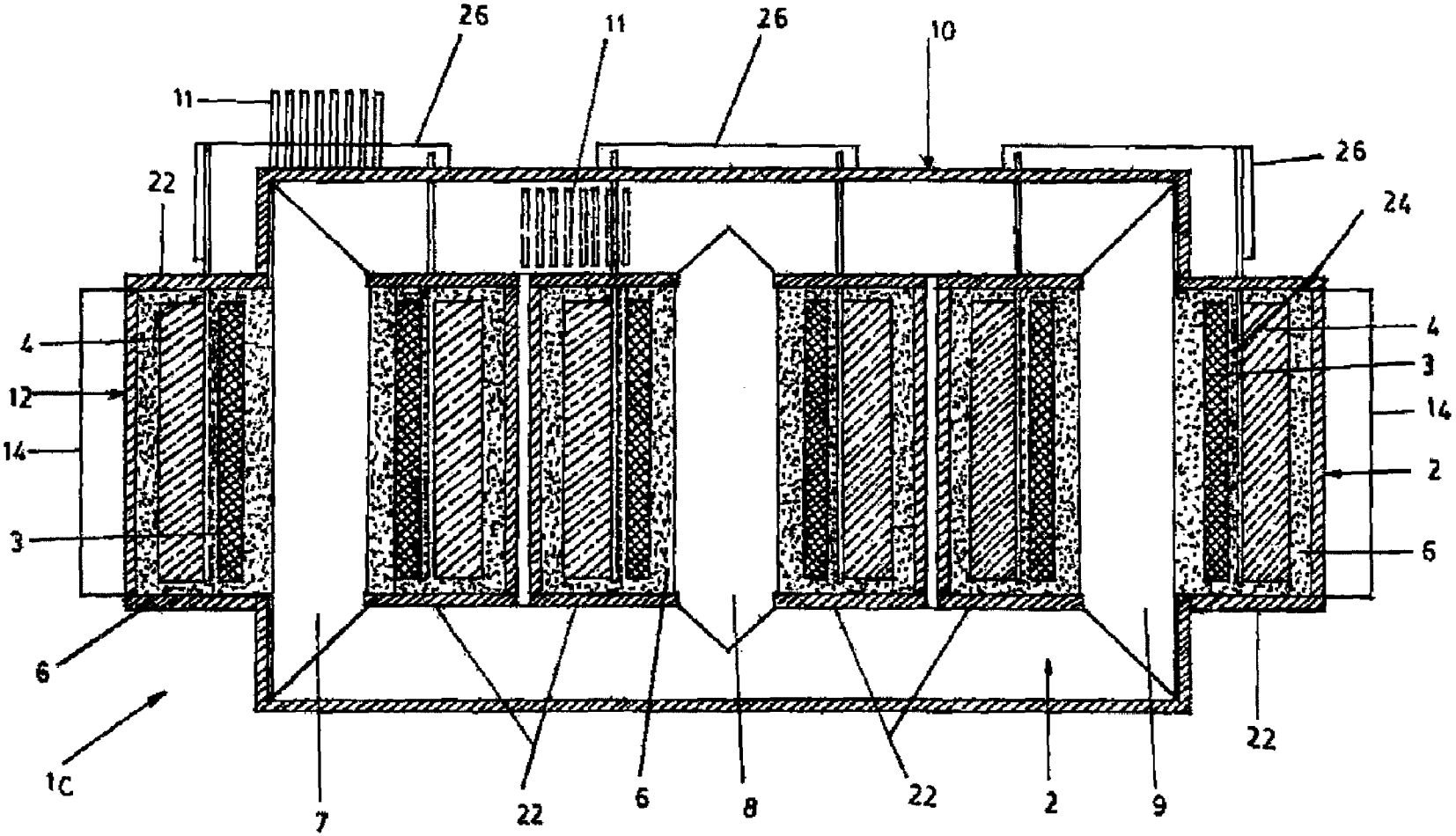
FIG. 10 is crosssection of a compact dry transformer according to another embodiment of the invention.
Figure 11:
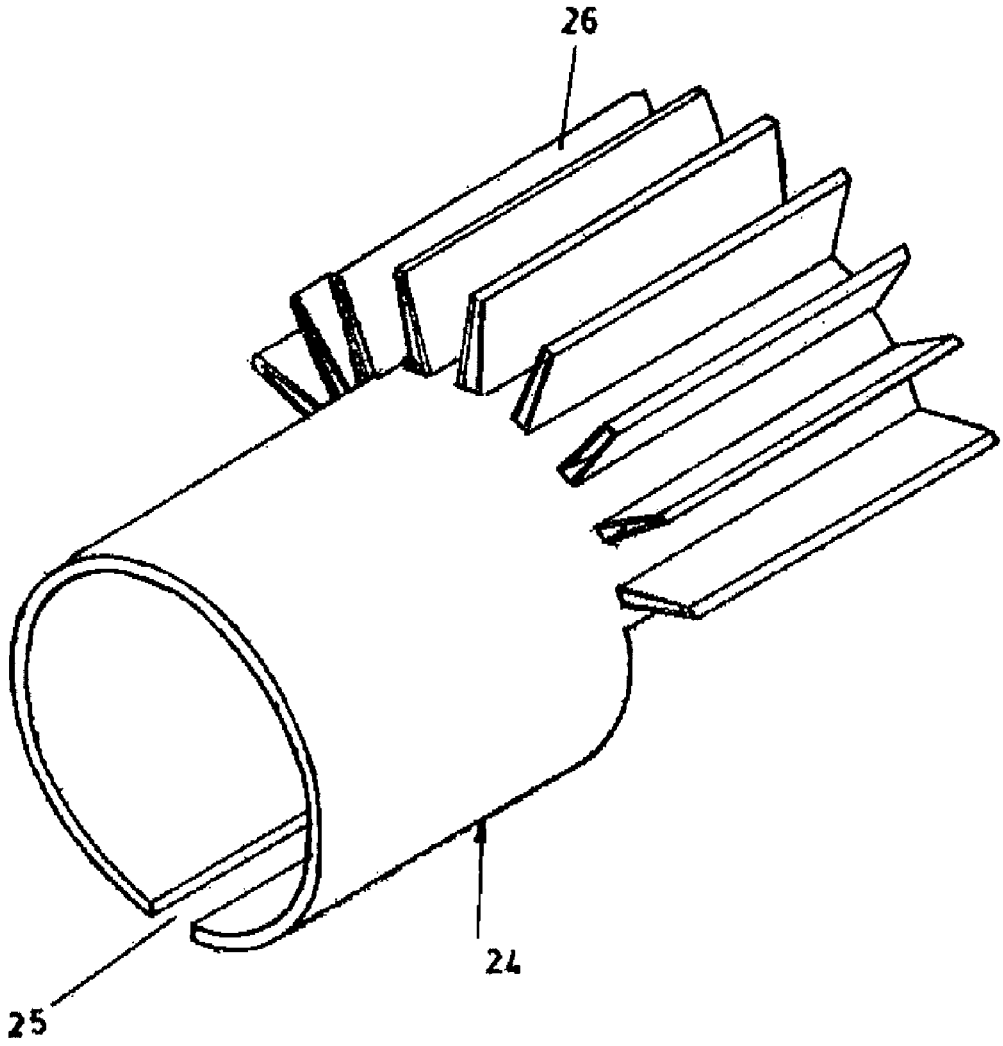
FIG. 11 is isometric view of a sleeve of the second heat sink of the transformer of FIG. 10.

The transformer 1C of FIGS. 10 and 11 of the accompanying drawings is the same as the transformer of FIGS. 1-8 but for the second heat sink which comprises enclosures 12 snug fitted over the resin impregnated and/or encapsulated windings on the limbs of the core and sleeves 24 each provided with a slit 25 along the length thereof and cooling fins 26 at one end thereof disposed outside the windings. The sleeves are inserted between the resin impregnated and/or encapsulated windings on the limbs of the core 2.

Figure 12:
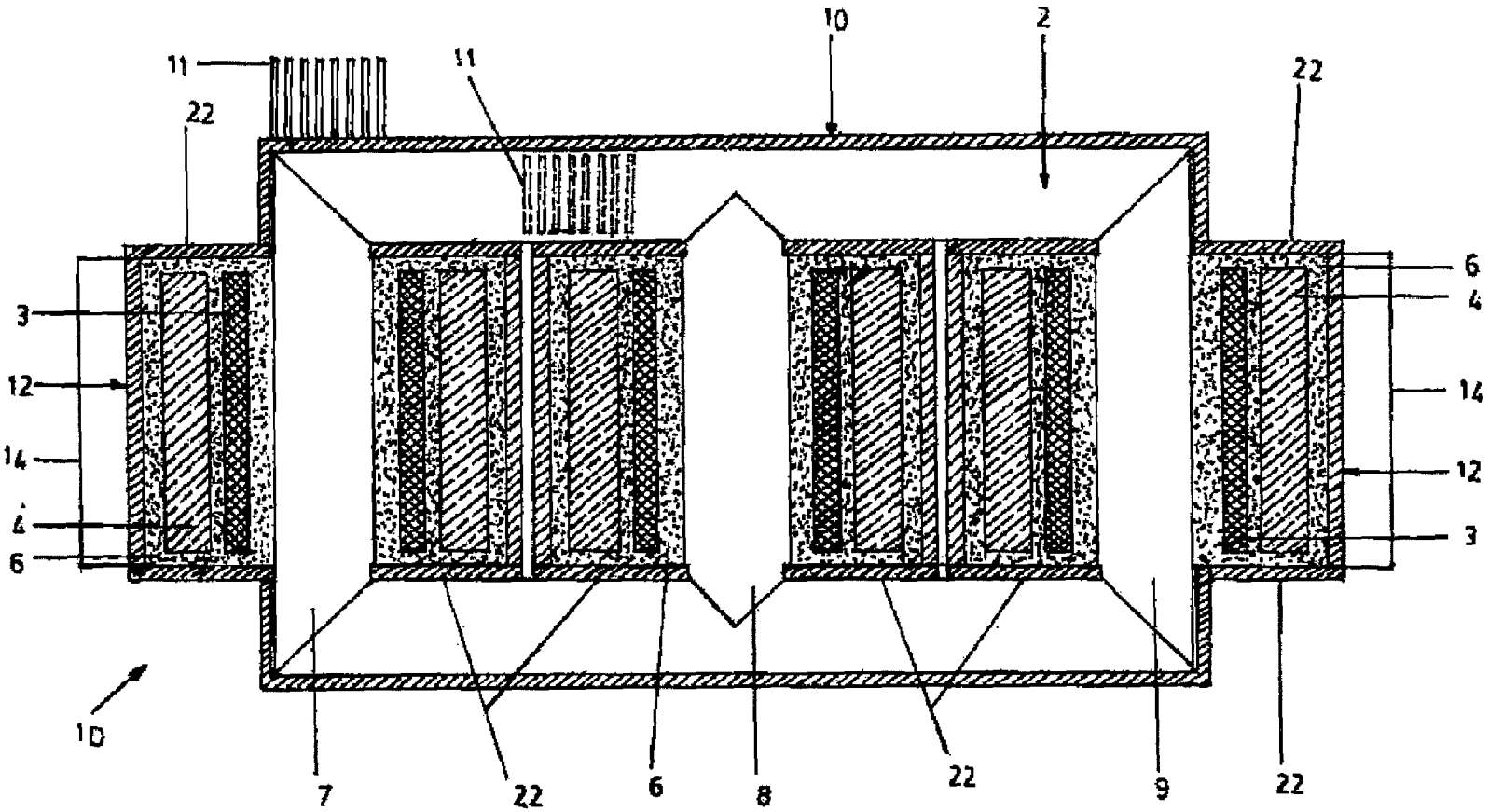
FIG. 12 is crosssection of a compact dry transformer according to another embodiment of the invention.

The transformer 1D of FIG. 12 of the accompanying drawings is the same as the transformer of FIGS. 1-8 except for the second heat sink which comprises enclosures 12 snug fitted over the resin impregnated and/or encapsulated windings on the limbs of the core 2.

The covers, enclosures, jackets or sleeves of the transformer are made of non-magnetic material having good thermal conductivity such as aluminium or copper. Aluminium is preferred for the covers, enclosures, jackets or sleeves because it is economical and easily available and has got good casting property and mass producibility. A typical thickness of 2-5 mm for the covers, enclosures, jackets or sleeves is preferred so as to minimise eddy current losses. The slits in the covers, enclosures, jackets or sleeves provide discontinuity to the current flow and thereby prevents short circuit in the transformer.

During operation of the transformer heat is generated both in the core and windings thereof. Heat in the core is conducted away by the covers and dissipated to the ambient by the cooling fins on the outer surface thereof by radiation and convection. Heat in the windings and core is conducted away by the enclosures and dissipated to the ambient by the fins on the outer surface thereof by radiation and convection. Similarly the heat in the windings and core is also conducted away by the sleeves and dissipated to the ambient by the cooling fins at the one end thereof by radiation and convection. Due to the heat in the windings and core the thermic fluid in the evaporator portions of the heat pipes evaporates and the vapours travel to the condenser portions thereof taking away the heat in the windings and core. The vapours condense in the condenser portions of the heat pipes giving out the heat to the ambient. The fins on the outer surface of the condenser portions of the heat pipes facilitate the heat transfer to the ambient by radiation and convection. Therefore, heat dissipation efficiency of the transformer is improved.

Comparative computer simulation studies between a conventional dry transformer and transformer according to the invention were carried out and the results were as shown in the following Table.

TABLE

| | Average Temperature rise | | Conductor area | | Winding size | |
|---|---|---|---|---|---|---|
| Transformer | HV winding | LV winding | HV winding | LV winding | HV winding | LV winding |
| 3Φ, 25 KVA conventional dry power transformer | 56° C. | 65° C. | 0.95 $mm^2$ | 47.62 $mm^2$ | 167(ID)/ 209(OD) 731(H) | 108(ID)/ 135(OD) 731(H) |
| 3Φ, 25 KVA dry power transformer of FIG. 1 of the invention | 63° C. | 53° C. | 0.398 $mm^2$ | 12 $mm^2$ | 132(ID)/ 192(OD) 207(H) | 108(ID)/ 126(OD) 207(H) |

It is seen from the Table that temperature rise in the core and windings of the transformer of the invention is comparable to the temperature rise in the core and windings of the conventional transformer of equivalent rating. The Table also shows that the crosssectional area of the windings of the transformer of the invention is smaller as compared to that of the conventional transformer. Because of the improved heat dissipation efficiency of the transformer of the invention it is possible to operate it with higher current densities. Due to the reduced crosssectional area of the windings the size and weight of the core and coil assembly is reduced. Therefore, the transformer is compact and no load losses are reduced. The invention eliminates the protective metallic tank. The covers and the enclosures provide protection to the core and the windings against environment. Therefore, the transformer of the invention may be used for both indoor and outdoor applications.

The transformer may be single or multi-phase and the coil assembly may comprise windings accordingly. Such variations of the invention are to be construed and understood to be within the scope thereof.

The invention claimed is:

1. Compact dry transformer consisting of a magnetic material core and a coil assembly consisting of resin impregnated and/or encapsulated windings with insulation between the turns and layers of the windings and assembled onto the core, the core consisting of a first heat sink consisting of covers made of non-magnetic material having good thermal conductivity snug fitted over the core and provided with cooling fins on the outer surface thereof and the coil assembly consisting of a second heat sink consisting of enclosures made of non-magnetic material having good thermal conductivity snug fitted over the resin impregnated and/or encapsulated windings on the limbs of the core and provided with slits along the length thereof and cooling fins on the outer surface thereof, the second heat sink further consisting of jackets made of non-magnetic material having good thermal conductivity inserted over the limbs of the core and provided with slits along the length thereof and a plurality of heat pipes each consisting of an evaporator portion and a condenser portion and containing a thermic fluid having low boiling point at vacuum, the evaporator portion being located in pockets or holes provided along the jackets radially spaced and the condenser portion being disposed outside the jackets and provided with cooling fins on the outer surface thereof.

2. Compact dry transformer consisting of a magnetic material core and a coil assembly consisting of resin impregnated and/or encapsulated windings with insulation between the turns and layers of the windings and assembled onto the core, the core consisting of a first heat sink consisting of covers made of non-magnetic material having good thermal conductivity snug fitted over the core and provided with cooling fins on the outer surface thereof and the coil assembly consisting of a second heat sink consisting of enclosures made of non-magnetic material having good thermal conductivity snug fitted over the resin impregnated and/or encapsulated windings on the limbs of the core and provided with slits along the length thereof and cooling fins on the outer surface thereof, the second heat sink further consisting of sleeves made of non-magnetic material having good thermal conductivity disposed between the windings and provided with slits along the length thereof and cooling fins at one end thereof disposed outside the windings.

3. Compact dry transformer consisting of a magnetic material core and a coil assembly consisting of resin impregnated and/or encapsulated windings with insulation between the turns and layers of the windings and assembled onto the core, the core consisting of a first heat sink consisting of covers made of non-magnetic material having good thermal conductivity snug fitted over the core and provided with cooling fins on the outer surface thereof and the coil assembly consisting of a second heat sink consisting of enclosures made of non-magnetic material having good thermal conductivity snug fitted over the resin impregnated and/or encapsulated windings on the limbs of the core and provided with slits along the length thereof and cooling fins on the outer surface thereof.

4. Compact dry transformer, as claimed in claim 1, 2 or 3, wherein the thickness of the covers, enclosures, jackets or sleeves is 2 to 5 mm.

* * * * *